US005609698A

United States Patent [19]

Kelly et al.

[11] Patent Number: 5,609,698

[45] Date of Patent: Mar. 11, 1997

[54] PROCESSING OF GAMMA TITANIUM-ALUMINIDE ALLOY USING A HEAT TREATMENT PRIOR TO DEFORMATION PROCESSING

[75] Inventors: Thomas J. Kelly, Cincinnati; Curtiss M. Austin, Loveland; Robert E. Allen, Cincinnati, all of Ohio

[73] Assignee: General Electric Company, Cincinnati, Ohio

[21] Appl. No.: 376,519

[22] Filed: Jan. 23, 1995

[51] Int. Cl.[6] ..... C22F 1/18

[52] U.S. Cl. ..... 148/671; 148/670

[58] Field of Search ..... 148/670, 671

[56] References Cited

U.S. PATENT DOCUMENTS 5,076,858 12/1991 Huang et al. ..... 148/670
5,190,603 3/1993 Nazmy et al. ..... 148/671
5,256,202 10/1993 Hanamura et al. ..... 148/670
5,417,781 5/1995 McQuay et al. ..... 148/670

*Primary Examiner*—John Sheehan
*Attorney, Agent, or Firm*—Andrew C. Hess; David L. Narciso

[57] ABSTRACT

An as-cast gamma titanium-aluminide alloy, typically having a composition of from about 45.0 to about 48.5 atomic percent aluminum, is pre-HIP heat treated at a temperature of from about 1900° F. to about 2100° F. for a time of from about 50 to about 5 hours. The gamma titanium-aluminide alloy is thereafter hot isostatically pressed at a temperature of about 2200° F. Hot isostatic pressing is preferably followed by a further heat treatment at a temperature of about 1850°–2200° F.

13 Claims, 2 Drawing Sheets

PROCESSING OF GAMMA TITANIUM-ALUMINIDE ALLOY USING A HEAT TREATMENT PRIOR TO DEFORMATION PROCESSING

BACKGROUND OF THE INVENTION

This invention relates to the thermal processing of metallurgical alloys, and, more particularly, to the heat treating of gamma titanlum-aluminide alloys.

Titanium aluminides are a class of alloys whose compositions include at least titanium and aluminum, and typically some additional alloying elements such as chromium, niobium, vanadium, tantalum, manganese, or boron. The gamma titanium aluminides are based on the gamma phase field found at nearly the equiatomic composition, with roughly 50 atomic percent each of titanium and aluminum, or a slightly reduced aluminum content to permit the use of other alloying elements. The titanium aluminides, and particularly the gamma titanlum-aluminide alloys, have the advantages of low density, good low and Intermediate temperature strength and cyclic deformation resistance, and good environmental resistance.

Gamma titanium aluminides have application In aircraft engines. They can potentially be used in applications such as low-pressure turbine blades and vanes, bearing supports, compressor casings, high pressure and low pressure hangars, frames, and low pressure turbine brush seal supports.

One area of continuing concern in the titanium aluminides, and particularly the gamma titanium aluminides, is their low-to-moderate levels of ductility. Ductility is the measure of how much a material can elongate before it fails, and is linked to other properties such as fracture resistance. The gamma titanium-aluminide alloys typically elongate at most only 1–4 percent prior to failure, and have a steeply rising stress-strain curve. Maintaining the strength and resistance of the material to premature failure is therefore highly dependent upon controlling the alloy ductility.

Gamma titanium aluminides are typically prepared by melting, casting, hot isostatic pressing to reduce the porosity resulting from the casting, and thereafter heat treating to achieve an acceptable ductility level. It has been found from experience that the preferred combination of hot isostatic pressing and heat treating temperatures for optimum ductility depends upon the aluminum content of the alloy. That is, different processing procedures have been developed for gamma titanium-aluminide alloys of different aluminum contents. Even then, however, the aluminum content is sometimes difficult to control and measure with the accuracy required in the selection of the preferred processing.

One solution to this problem has been to use a combination of a moderate hot isostatic pressing temperature of 2200° F. followed by a high heat treating temperature of 2375° F. that produces reasonably good ductility properties for a wide range of aluminum contents. Unfortunately, the high heat treating temperature In this processing requires a specialized furnace that is expensive and may not be economically available in all instances.

There is a need for an improved processing procedure for gamma titanium-aluminide alloys to attain good properties using readily available and economic processing facilities. The present invention fulfills this need, and further provides related advantages.

SUMMARY OF THE INVENTION

The present invention provides a thermal processing sequence for gamma titanium-aluminide alloys that yields good strength and ductility in the final product. The processing is accomplished using only moderate thermal processing temperatures and moderate hot isostatic pressing temperatures. Expensive high-temperature heat treating facilities are not required. The single type of processing is operable over a wide range of aluminum contents, so that the processing is tolerant of variations in the aluminum content of the alloy.

In accordance with the invention, a method for processing a titanium alloy comprises the steps of furnishing a gamma titanium-aluminide alloy having a metastable microstructure, and pretreating the gamma titanium-aluminide alloy to stabilize the metastable microstructure of the gamma titanium-aluminide alloy. The gamma titanium-aluminide alloy is preferably in cast form with a composition of from about 45.0 to about 48.5 atomic percent aluminum, and optionally with other alloying additions. Pretreating may be accomplished by heating the gamma titanium-aluminide alloy to a temperature of from about 1900° F. to about 2100° F. for a time of from about 50 to about 5 hours.

The method further includes deformation processing the gamma titanium-aluminide alloy after the step of pretreating. Deformation processing is typically accomplished by hot isostatic pressing (sometimes termed in the art "HIPing") the pretreated alloy to reduce porosity contained within the structure, but may also be performed by other deformation techniques. For the preferred case, the deformation processing is accomplished by hot isostatic pressing at a temperature of from about 2150° F. to about 2300° F. at a pressure of from about 25,000 pounds per square inch (psi) to about 15,000 psi and for a time of from about 3 hours to about 10 hours. This hot isostatic pressing has been found effective in closing porosity present in the as-cast or pressed powder structure.

Optionally, the pretreated and deformation processed gamma titanium-aluminide alloy may be heat treated to produce a desired final structure. A preferred heat treatment is accomplished by heating the gamma titanium-aluminide alloy to a temperature of from about 1850° F. to about 2200° F. for a time of from about 20 hours to about 2 hours. This range of final heat treatment temperatures can be characterized as moderate, and is well below the 2375° F. heat treatment temperature used previously.

This processing may be used over a wide range of aluminum and other alloy contents. Tests show that excellent properties are achieved over the preferred aluminum range of from about 45.0 to about 48.5 atomic percent aluminum. The properties are comparable to, or slightly exceed, those achieved with conventional hot isostatic pressing followed by the high-temperature heat treatment.

Other features and advantages of the present invention will be apparent from the following more detailed description of the preferred embodiment, taken in conjunction with the accompanying drawings, which illustrate, by way of example, the principles of the invention.

DETAILED DESCRIPTION OF THE INVENTION

Figure 1:
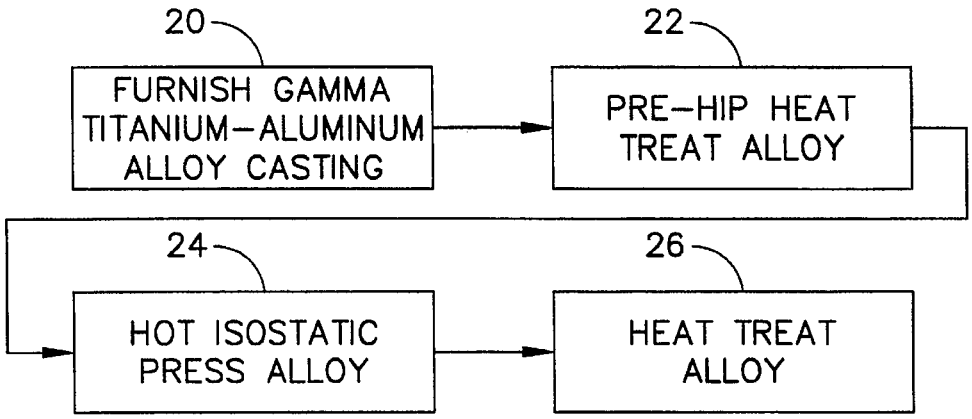
FIG. 1 is a process flow diagram for the method of the invention.

FIG. 1 depicts in block diagram form the method according to the invention. A gamma titanium-aluminide cast alloy is furnished, numeral 20. The invention is applicable to alloys which have compositions capable of forming alpha, alpha-2, and gamma phases as the alloy is cooled from the melt. These alloys are usually termed "gamma" titanium aluminide alloys in the art, even though they are not fully within the gamma phase field. That usage is adopted here. The gamma titanium aluminides typically are alloys of titanium, from about 40–50 atomic percent aluminum, and optionally small amounts of other alloying elements such as chromium, niobium, vanadium, tantaium, manganese, or boron. All alloy compositions herein are in atomic percent, unless indicated to the contrary.

The preferred compositions have from about 45.0 to about 48.5 atomic percent aluminum, and are therefore at the high end of the operable range. They also typically include small amounts of other alloying elements. Some preferred gamma titanium aluminides include Ti-48Al-2Cr-2Nb, Ti-48Al-2Mn-2Nb, Ti-49Al-1V, Ti-47A1-1Mn-2Nb-0.5W-0.5Mo-0.2Si, and Ti-47Al-5Nb-1W.

When such a gamma titanium aluminide is cooled from the molten state, it typically passes through a high-temperature peritectic reaction and into an alpha-titanium phase field (termed herein an "alpha" phase). Upon cooling, the alloying passes into an alpha-plus gamma phase field. The line between the alpha and alpha-plus-gamma phase fields is termed the alpha transus. Upon further cooling, the alloy passes through a eutectoid reaction at a eutectoid temperature that is ordinarily at about 1900°–2000° F., and into an alpha-2-plus-gamma phase field that extends downwardly in temperature to ambient temperature. Although the binary titanium-aluminum phase diagram is known reasonably well, the phase diagrams and continuous cooling diagrams of the more complex ternary and quaternary alloys are in many cases not known with certainty. The above description of the phases formed during cooling, developed from the binary phase diagram, is therefore intended to provide a general idea of the phases and transformations, but is not intended to be specific to particular complex alloys.

When a gamma titanium-aluminide alloy is melted, cast, and cooled, the piece usually has a considerable amount of porosity, and its microstructure is metastable and irregular. By "metastable" is meant that the microstructure is not in a stable form, but can be transformed to a more stable form by heat treatment. Adding to the problems in dealing with these alloys is a difficulty in providing alloys with specific aluminum content and even in measuring the aluminum content accurately. These characteristics lead to low and often-uncontrolled ductility, as well as low yield and ultimate strengths, unless the alloys are properly processed.

The cast gamma titanium aluminide is given a pretreatment which, for subsequent processing by hot isostatic pressing (HIPing), may be viewed as a pre-HIP heat treatment, numeral 22. In the preferred pretreatment for alloys having from about 45.0 to about 48.5 atomic percent aluminum, the commercially most important range of the gamma titanium aluminides, the alloy is heated to a temperature of from about 1900° F. to about 2100° F. for a time of from about 50 to about 5 hours. The heat treatment is preferably performed in vacuum, but may in some cases be done in an inert gas such as argon.

The pre-HIP heat treatment transforms the metastable gamma titanium-aluminide structure to an entirely, or at least predominantly, stable state. The term "stable" as used herein is not meant to suggest a thermodynamic state of the lowest possible free energy. Instead, "stable" means that the metallurgical microstructure will not substantially further transform during subsequent deformation processing in a temperature range of from about 2150° F. to about 2500° F.

The preferred heat treatment for alloys having from about 45.0 to about 48.5 atomic percent aluminum is at a temperature of from about 1900° F. to about 2100° F. This temperature is about, and preferably just below, the eutectoid temperature for the alloys, to avoid the formation of alpha phase during the pre-HIP treatment, but sufficiently high to achieve the desired transformation results in a reasonable pre-HIP heat treating time. This pre-HIP heat treatment temperature is operable over the full range of from about 45.0 to about 48.5 atomic percent aluminum, and permits a range of alloys having a wide variation in aluminum contents to be processed with a single procedure. This tolerance of variations in aluminum content is an important advantage of the invention, because it avoids the need to determine the aluminum content with high precision and then to change the processing responsively, as has been the practice required for some of the prior processing procedures to achieve good properties.

For gamma titanium-aluminide alloys with less than about 45.0 atomic percent aluminum, the pre-HIP heat treatment temperature is preferably reduced so as to always be below the alpha transus temperature. The pre-HIP heat treatment temperature for such alloys is preferably from about 200° F. to about 400° F. below the alpha transus temperature.

The pre-HIP heat treatment 22 is typically performed in a furnace, and the treated alloy is thereafter cooled to about ambient temperature and placed into a hot isostatic pressing apparatus. Hot isostatic pressing is conducted, numeral 24, to consolidate the alloy piece by reducing, and preferably closing, internal pores within the piece. Hot isostatic pressing is a well-known type of processing, and the apparatus is also well known. In the preferred approach, hot isostatic pressing is performed at a temperature of from about 2150° F. to about 2300° F. at a pressure of from about 25,000 pounds per square inch (psi) to about 15,000 psi and for a time of from about 3 hours to about 10 hours. Insufficient closure is obtained for lower temperatures, pressures, and times. Higher temperatures become increasingly impractical due to the more-complex equipment required, and may also lead to undesirable microstructures In the final product, After hot isostatic pressing is complete, the article is cooled and removed from the apparatus.

The preferred application of the present invention is with deformation processing performed by hot isostatic pressing. It may be practiced with other types of deformation processing, wherein the alloy article is heated and simultaneously deformed, For example, rolling and extrusion may be used as the deformation processing.

The processing may be complete at thls point. Preferably, however, a heat treatment is used after the deformation processing is complete, numeral 26. In the preferred heat treatment the deformation-processed article is heated to a temperature of from about 1850° F. to about 2200° F. for a time of from about 20 hours to about 2 hours. This heat treatment has been found effective in further improving the properties of the final product.

The present invention has been practiced using specimens of a gamma titanium-aluminide alloy, and the same alloy has been processed by the favored prior approach as a basis of comparison. The alloy has a nominal composition, in atomic percentages, of Ti-xAl-2Cr-2Nb, where x is nominally 48 but has been here Intentionally varied from about 45.0 to about 48.5. These specimens have been given three different heat processing approaches: (1) a conventional processing, termed LH processing, wherein no pre-HIP treatment was used, the HIP was at 2200° F., and the final heat treatment was 2375° F. for 20 hours; (2) a first processing according to the invention, termed PLL processing, which included a pre-HIP treatment of 2100° F. for 5 hours, HIP at 2300° F., and heat treat at 2200° F. for 2 hours; and (3) a second processing according to the invention, termed PLL processing, which Included a pre-HIP treatment of 2100° F. for 5 hours, HIP at 2200° F., and heat treat at 2200° F. for 2 hours.

Figure 2:
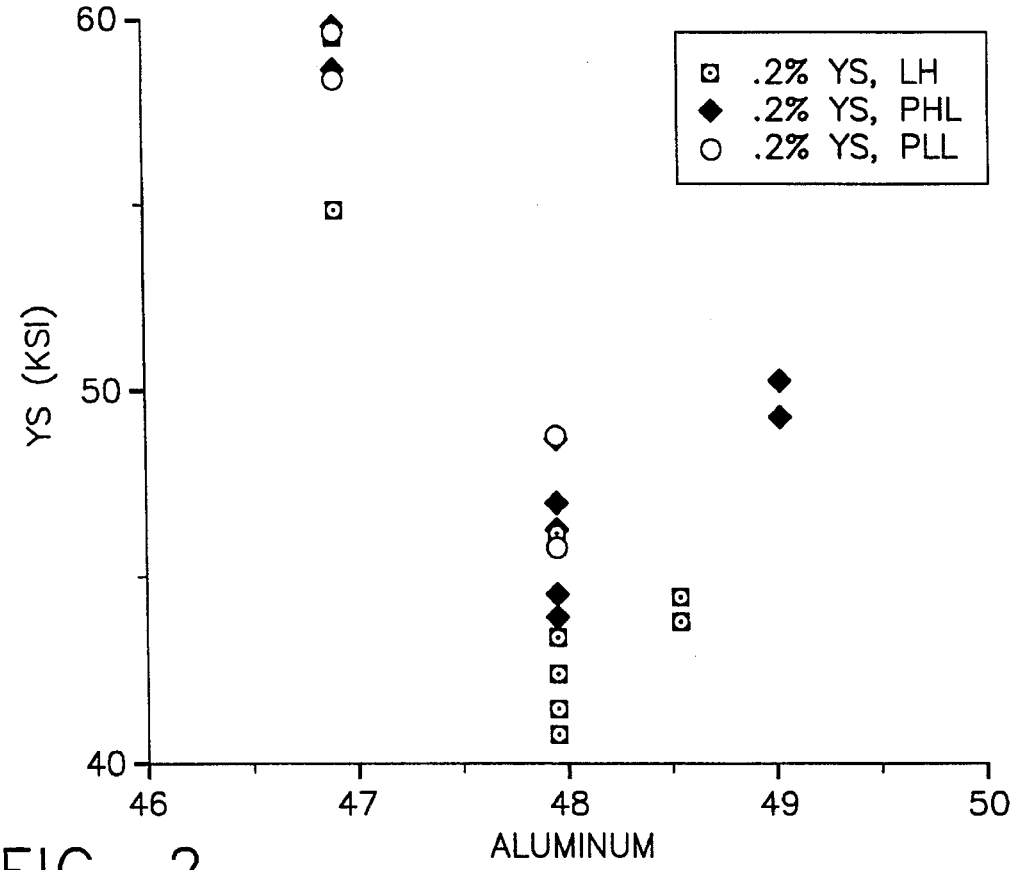
FIG. 2 is a graph of 0.2 percent yield strength as a function of aluminum content for specimens prepared by the present approach and the prior approach.
Figure 3:
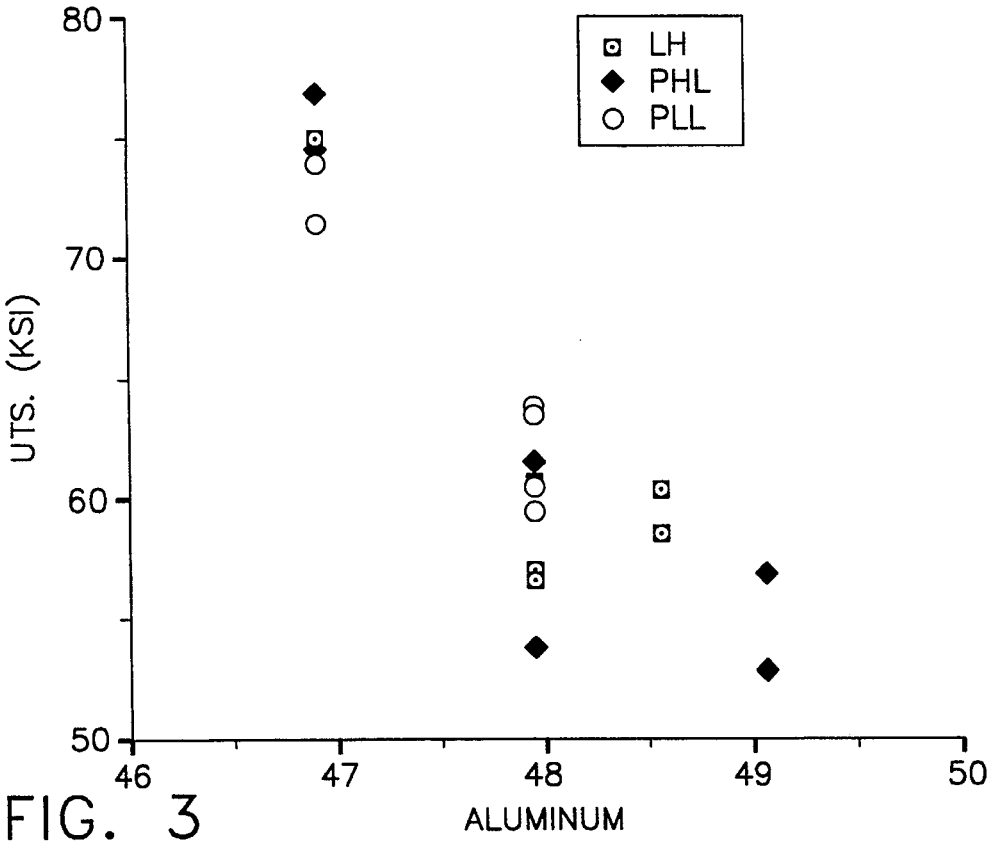
FIG. 3 is a graph of ultimate tensile strength as a function of aluminum content for specimens prepared by the present approach and the prior approach.
Figure 4:
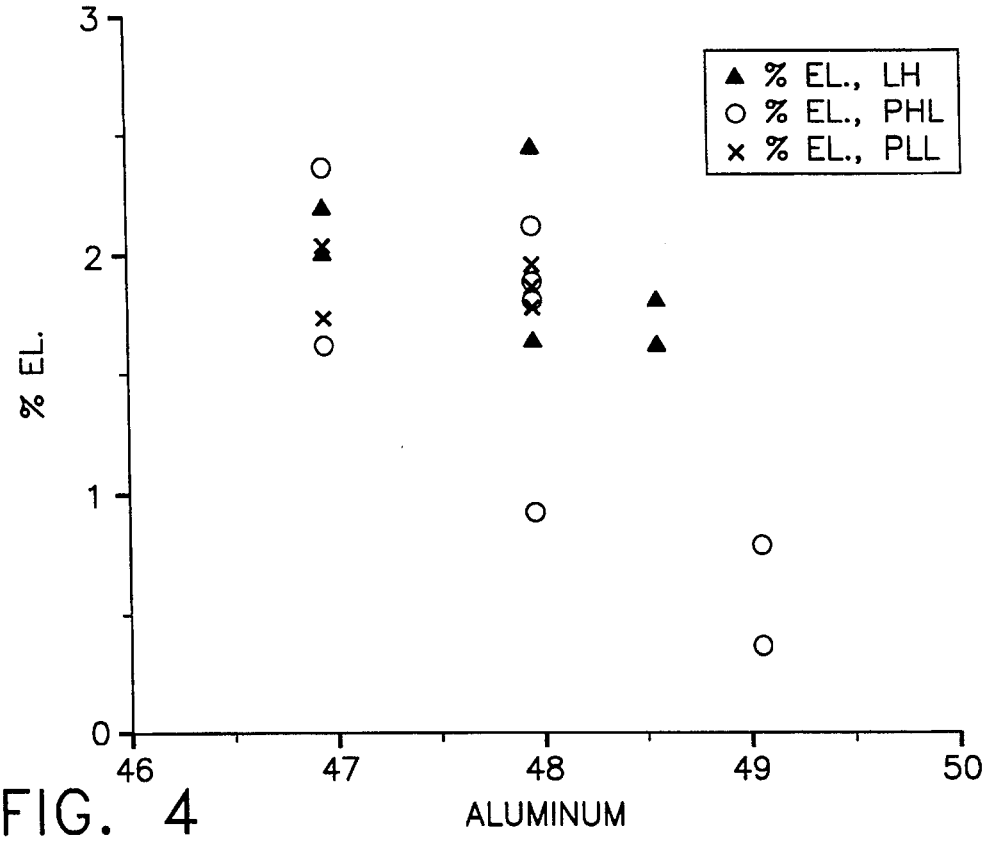
FIG. 4 is a graph of ductility as a function of aluminum content for specimens prepared by the present approach and the prior approach.

FIGS. 2–4 illustrate ambient-temperature tensile test data obtained from the specimens. As shown in FIG. 2, the 0.2 percent yield strength obtained with both the PHL and PLL heat treatments is superior to that obtained wlth the prior LH approach. The ultimate tensile strength for both the PHL and PLL heat treatments is about the same as that for the prior LH approach, as seen in FIG. 3. FIG. 4 shows that the PHL treatment gives about the same elongation to failure as the prior LH approach, but the PLL treatment is not as good as either of these treatments.

Thus, the present invention provides properties that are comparable to those obtained wlth the prior approach. The present approach has the important advantage, however, that it does not require the high-temperature final heat treatment at 2375° F. of the prior approach and consequently does not require a furnace operable at this temperature.

This invention has been described in connection wlth specific embodiments and examples. However, those skilled in the art will recognize various modifications and variations of which the present invention is capable without departing from its scope as represented by the appended claims.

What is claimed is:

1. A method for processing a titanium-aluminide alloy, comprising the steps of:

furnishing an as-cast gamma titanium-aluminide alloy having a metastable microstructure, the alloy being in the shape of an article selected from the group consisting of a low-pressure turbine blade, a low-pressure turbine vane, a bearing support, a compressor casing, a high-pressure hanger, a low-pressure hanger, a frame, and a low pressure turbine brush seal support;

pretreating the gamma titanium-aluminide alloy to stabilize the metastable microstructure of the gamma titanium-aluminide alloy; and hot isostatic pressing the gamma titanium-aluminide alloy, the step of hot isostatic pressing to occur after the step of pretreating.

2. The method of claim 1, wherein the step of furnishing includes the step of furnishing the gamma titanium-aluminide alloy in an as-cast form.

3. The method of claim 1, wherein the step of furnishing a gamma titanium-aluminide alloy includes the step of furnishing an alloy selected from the group having compositions, in atomic percent, of Ti-48Al-2Cr-2Nb, Ti-48Al-2Mn-2Nb, Ti-49Al-1V, Ti-47Al-1Mn-2Nb-0.5W-0.5Mo-.2Si, and Ti-47Al-5Nb-1W.

4. The method of claim 1, wherein the step of pretreating includes the step of heating the gamma titanium-aluminide alloy to a pretreatment temperature of from about 1900° F. to about 2100° F.

5. The method of claim 4, wherein the step of heating includes the step of maintaining the gamma titanium-aluminide alloy at the heat treatment temperature for a time of from about 5 to about 50 hours.

6. The method of claim 1, including an additional step, after the step of hot isostatic pressing is complete, of heat treating the gamma titanium-aluminide alloy.

7. The method of claim 6, wherein the step of heat treating includes the step of heating the gamma titanium-aluminide alloy to a temperature of from about 1850° F. to about 2200° F. for a time of from about 20 hours to about 2 hours.

8. A method for processing a titanium alloy, comprising the steps of:

furnishing a gamma titanium-aluminide alloy in an as-cast form;

pre-HIP heat treating the gamma titanium-aluminide alloy at a pre-HIP heat treatment temperature of about the eutectoid temperature;

hot isostatic pressing the gamma titanium-aluminide alloy, the step of hot isostatic pressing to occur after the step of pre-HIP heat treating; and, after the step of hot isostatic pressing is complete, heat treating the gamma titanium-aluminide alloy by heating the gamma titanium-aluminide alloy to a temperature of from about 1850° F. to about 2200° F. for a time of from about 20 hours to about 2 hours.

9. The method of claim 8, wherein the step of furnishing includes the step of furnishing a titanium-aluminide alloy having from about 45.0 to about 48.5 atomic percent aluminum, and wherein the step of pre-HIP heat treating includes the step of heating the gamma titanium-aluminide alloy to a pre-HIP heat treatment temperature of from about 1900° F. to about 2100° F.

10. The method of claim 9, wherein the step of heating includes the step of maintaining the gamma titanium-aluminide alloy at the pre-HIP heat treatment temperature for a time of from about 5 to about 50 hours.

11. The method of claim 8, wherein the step of hot isostatic pressing includes the step of hot isostatic pressing the gamma titanium-aluminide alloy at a temperature of from about 2150° F. to about 2300° F. at a pressure of from about 25,000 pounds per square inch to about 15,000 pounds per square inch and for a time of from about 3 hours to about 10 hours.

12. A method for processing a titanium alloy, comprising the steps of:

furnishing an as-cast gamma titanium-aluminide alloy having from about 45.0 to about 48.5 atomic percent aluminum;

pre-HIP heat treating the gamma titanium-aluminide alloy at a pre-HIP heat treatment temperature of from about 1900° F. to about 2100° F. for a time of from about 50 to about 5 hours;

hot isostatic pressing the gamma titanium-aluminide alloy at a temperature of about 2150° F., at a pressure of about 25,000 pounds per square inch, and for a time of from about 3 to about 5 hours, the step of hot isostatic pressing to occur after the step of pre-HIP heat treating is complete; and heat treating the gamma titanium-aluminide alloy at a temperature of from about 1850° F. to about 2200° F. for a time of from about 20 hours to about 2 hours, the step of heat treating to occur after the step of hot isostatic pressing is complete.

13. The method of claim 12, wherein the step of furnishing a gamma titanium-aluminide alloy includes the step of furnishing an alloy selected from the group having compositions, in atomic percent, of Ti-48Al-2Cr-2Nb, Ti-48Al-2Mn-2Nb, Ti-49Al-1V, Ti-47Al-1Mn-2Nb-0.5W-0.5Mo-.2Si, and Ti-47Al-5Nb-1W.

* * * * *